US008157666B2

(12) United States Patent
Schutte

(10) Patent No.: US 8,157,666 B2
(45) Date of Patent: Apr. 17, 2012

(54) GOLF DOWNSWING GUIDE

(76) Inventor: Alwyn Johannes Jacobus Schutte, Johannesburg (ZA)

( * ) Notice: Subject to any disclaimer, the term of this patent is extended or adjusted under 35 U.S.C. 154(b) by 0 days.

(21) Appl. No.: 12/868,783

(22) Filed: Aug. 26, 2010

(65) Prior Publication Data

US 2012/0052970 A1 Mar. 1, 2012

(51) Int. Cl.
*A63B 69/36* (2006.01)

(52) U.S. Cl. ..... 473/215; 473/212; 473/214

(58) Field of Classification Search ..... 473/63, 473/207, 212–216, 219, 266, 276, 277, 450
See application file for complete search history.

(56) References Cited

U.S. PATENT DOCUMENTS 2,773,691 A * 12/1956 Redfield ..... 473/212
4,612,919 A * 9/1986 Best ..... 602/16
4,718,665 A * 1/1988 Airy et al. ..... 482/119
5,048,831 A * 9/1991 Sides ..... 358/1.17
5,472,206 A * 12/1995 Manley et al. ..... 473/214
5,865,695 A * 2/1999 Mahala et al. ..... 473/450
6,645,093 B2 * 11/2003 Sheppard ..... 473/450
7,775,898 B1 * 8/2010 Allen ..... 473/214

* cited by examiner

*Primary Examiner* — Nini Legesse

(57) ABSTRACT

A golf downswing guide which prevents medial rotation (rotation towards the center of the body) of the right arm for a right handed golfer during the backswing but more specifically during the downswing.

The device consists of a lower and an upper elongated member joined together by an elbow joint which allows pivoting on a single plane. The device attaches to the right arm (for a right handed golfer)

A counter acting elongated member is mounted on the upper elongated member. A holding device with an elongated opening is attached to the torso of the golfer. During the backswing but more specifically the downswing, the counter acting elongated member stays inside the elongated opening of the holding device and prevents the counter acting elongated member from moving out of the elongated opening and consequently prevents the tight arm from medially rotating during the downswing.

14 Claims, 6 Drawing Sheets

GOLF DOWNSWING GUIDE

BACKGROUND OF THE INVENTION

1. Field of the Invention

The present invention relates to golf practice equipment. More specifically it relates to controlling the range of movement of the right arm (for a right handed golfer) and consequently the path delivery of the dub head during the downswing and at impact.

2. Description of the Prior Art

Could not find any prior art.

SUMMARY OF THE INVENTION

It is the object of this invention to provide the golfer with a training device preferably worn like a golf shirt which he or she can wear on the practice range and hit golf balls or play a round of golf while wearing the training device. The device assist in preventing "coming over the top" or in other words prevent the club head approaching the golf ball on a path which is to the outside (or to the right) of the intended target line.

Delivering the golf club on a path which is to the outside of the intended target or to "come over the top" as is referred to in golfing terms, is the most common fault amongst handicap players and is responsible for a wide array of poor shots.

Limiting the "over the top" movement is accomplished by limiting the range of motion of the right arm and more specifically preventing the right arm from medially rotating (rotating inwardly towards the stomach) in the downswing, until the golf ball is struck. This is achieved by a lower elongated member and an upper elongated member joined together by an elbow joint to allow hinging or pivoting on a single plane. The lower elongated member attaches to the lower part of the right arm underneath the elbow joint. The upper elongated member attaches to the upper part of the right arm above the elbow joint.

A counter acting rigid elongated member extends away from at an angle and is mounted on the said upper elongated member in a non movable way. A holding device which attaches to the torso of the golfer having a rigid elongated opening to allow the said counter acting elongated member to slide into, move around and slide out of the said elongated opening at certain stages during the swing. This holding device together with the counter acting elongated member inserted into the elongated opening will act as a resistance force during the downswing preventing the said counter acting elongated of moving outward and away from the torso during the downswing and thus preventing medial rotation of the right arm.

The device also has the added side benefit of preventing the right arm and right shoulder blade from moving horizontally in the downswing ensuring that the club head approaches the golf ball on a path square or slightly to the inside (to the left) of the intended target line.

Limiting these ranges of movement results in movement going where there is least resistance and the club head consequently travelling on a path which will approach the golf ball on a path slightly on the inside (to the left) or square of the intended target line.

BRIEF DESCRIPTION OF THE DRAWINGS

A fuller understanding of the nature and objects of the present invention will became apparent when considering the following detailed drawings with accompanying detailed descriptions, wherein.

DETAILED DESCRIPTION OF THE PREFERRED EMBODIMENTS

FIG. 1

Figure 1:
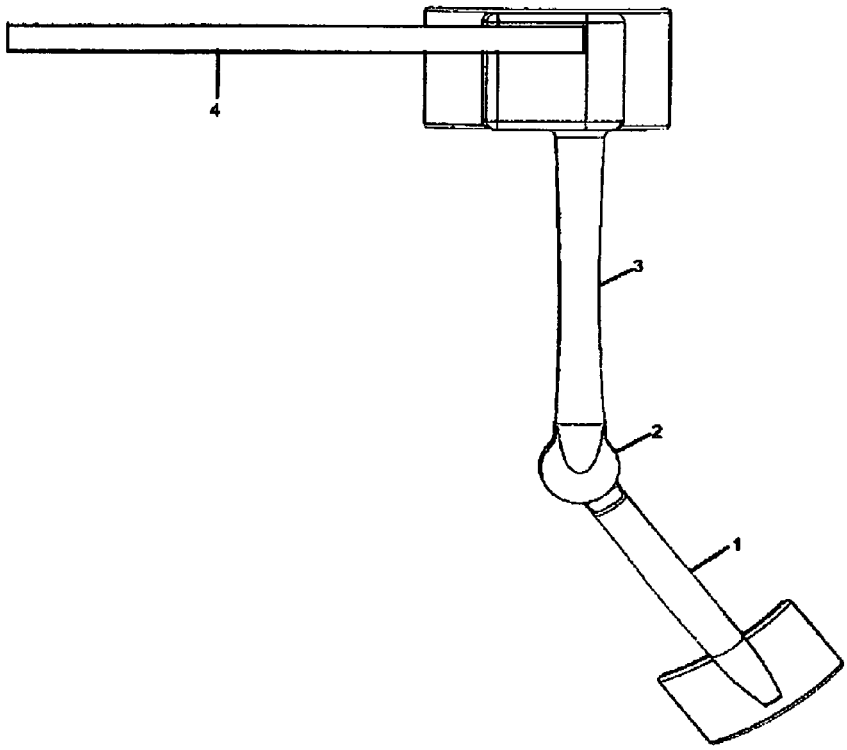
FIG. 1 is a side view of the lower, the upper and the counter acting elongated members which attaches to the right arm.
Figure 2:
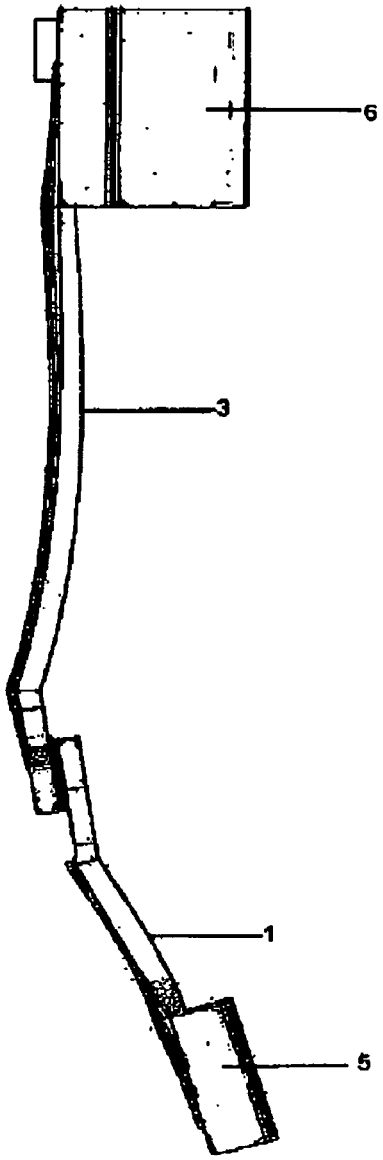
FIG. 2 is a top view of the lower, the upper and the counter acting elongated members which attaches to the right arm.
Figure 3:
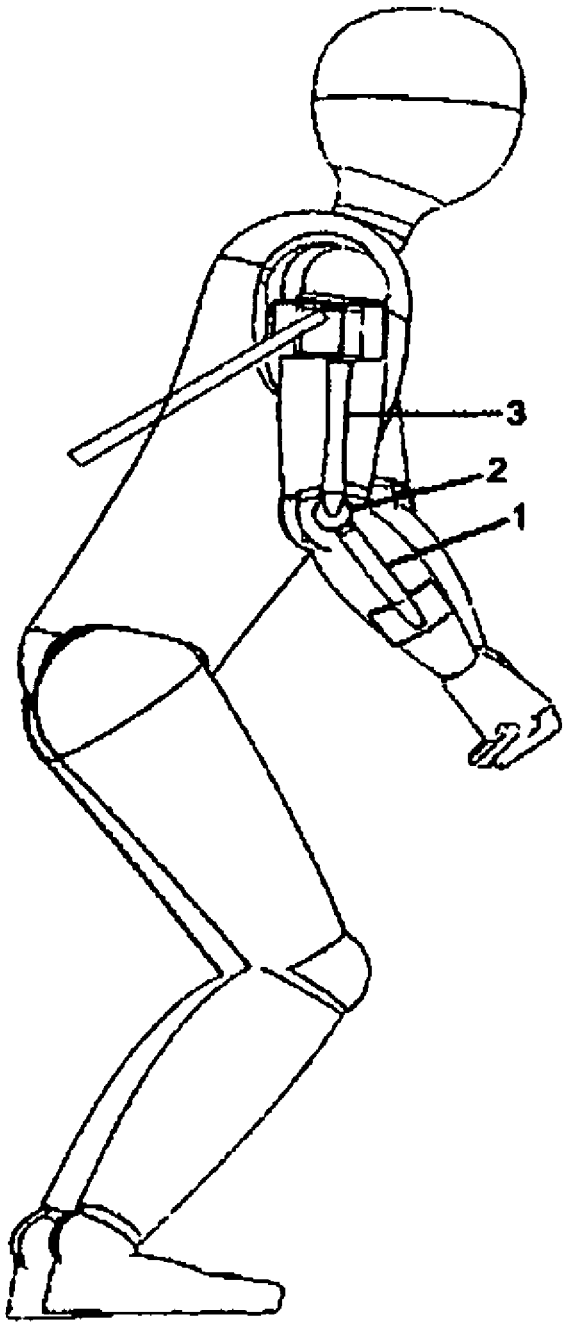
FIG. 3 is a side view of the lower, the upper and the counter acting elongated members attached to the right arm
Figure 4:
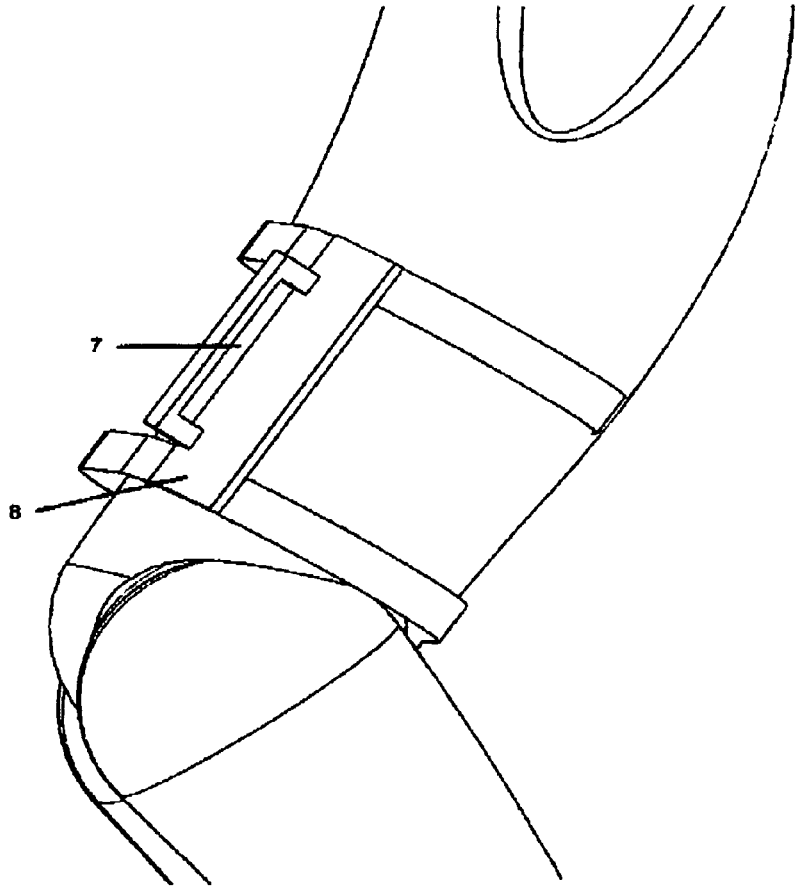
FIG. 4 is a side view of the holding device which attaches to the back right hand side of the torso.
Figure 5:
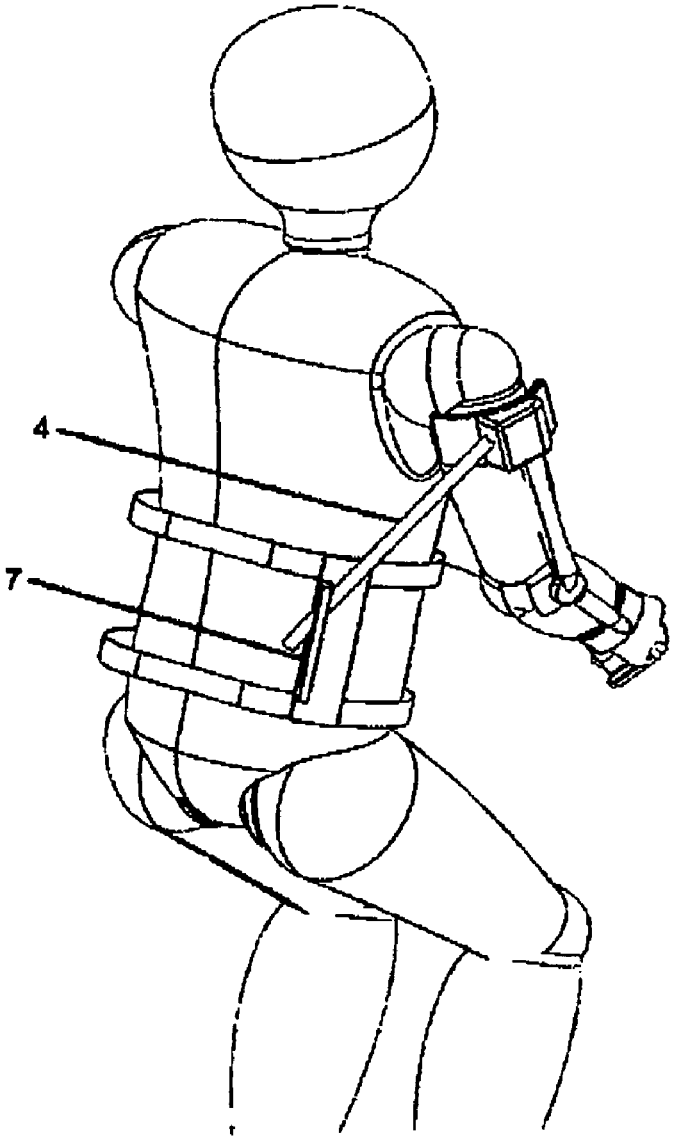
FIG. 5 is a side view showing the counter acting elongated member sliding into the elongated opening of the holding device as at address.
Figure 6:
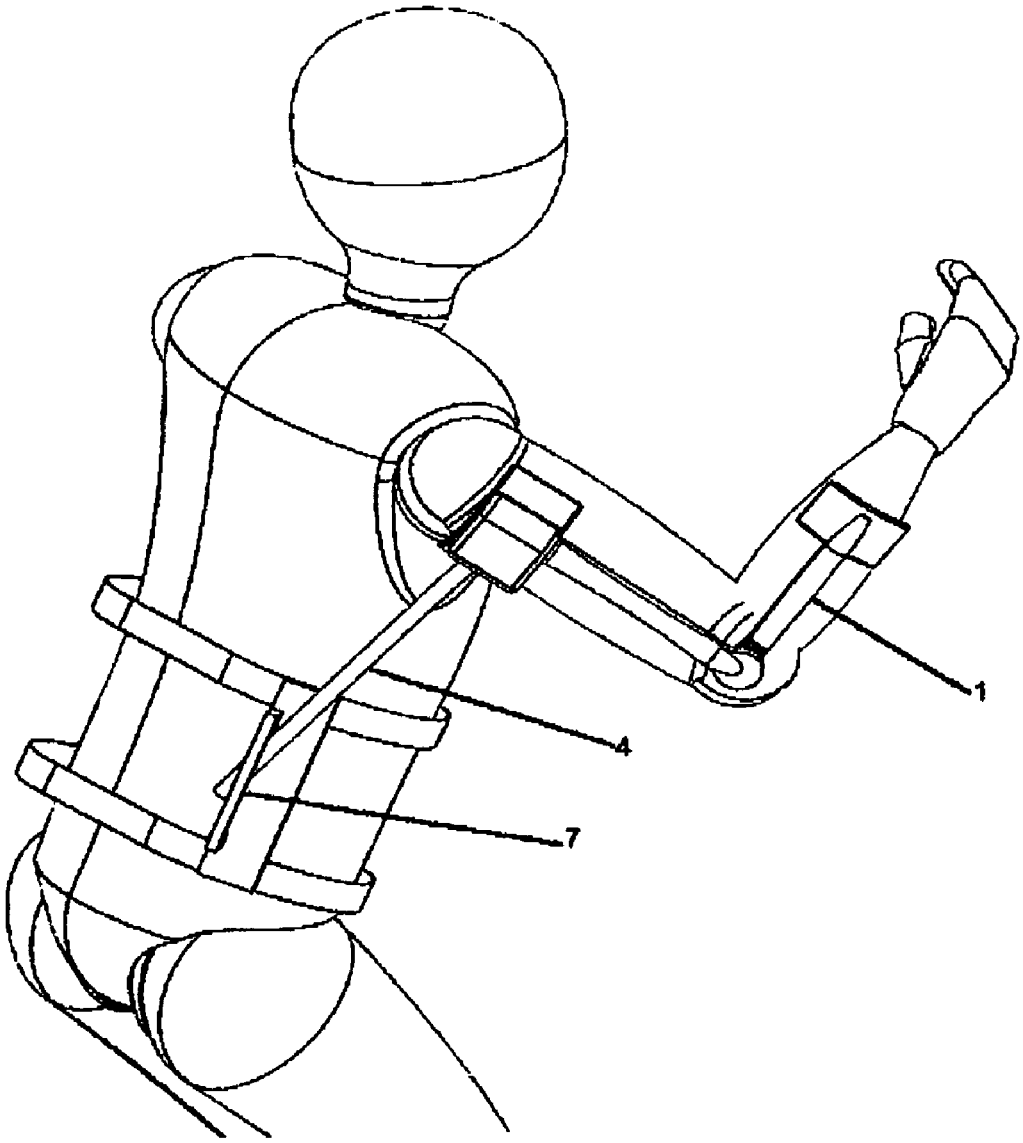
FIG. 6 is a side view showing the counter acting elongated member still positioned inside the elongated opening as at the top of the backswing

A side view of the lower (1), the upper (3) and the counter acting (4) elongated members. The device comprises of a lower elongated member (1) which attaches to the right forearm underneath the elbow joint. The length of the lower elongated member covers at least half of the lower part of the right arm.

An elbow joint (2) joins the lower elongated member to the upper elongated member (3) and allows pivoting on a single plane as the right arm hinges. The elbow joint (2) must preferably run on ball joints.

The upper elongated member (3) attaches to the top part of the right arm. The counter acting elongated member (4) is mounted in a non movable way on top of and towards the upper back end of the upper elongated member (3) and extend away at a very specific angle.

FIG. 2

A top view of the lower, the upper and the counter acting elongated members. The upper (3) and lower (1) elongated members are shaped in a curved fashion to match the shape of the right hand side of the extended right arm.

The rounded curves of the lower (5) and upper (8) elongated members provide stability for mounting purposes and space for padding support when attached to the right arm.

FIG. 3

A side view of the lower, the upper and the counter acting elongated members attached to the right arm. Wherein the lower (1) and upper (3) elongated members attach as close to possible to the middle of the right hand side of the right arm.

The elbow joint (2) must be at right angles to the golfers' elbow joint.

FIG. 4

A side view of the holding device attached to the middle back right hand side of the torso featuring an elongated opening (7) to accommodate the counter acting rigid elongated member (4) according to FIG. 1 sliding in and out of the elongated opening (7) at certain stages during the swing. The holding device has a base section (8) to assist in attaching the holding device securely to the torso.

FIG. 5

A side view of the holding device attached to the middle back right hand side of the torso with the counter acting elongated member (4) inserted into the elongated opening (7) as at address. Wherein the counter acting elongated member (4) only fully extend and slide into the elongated opening (7) by means of auto extension at address.

FIG. 6

A side view showing the counter acting elongated member (4) still positioned inside the elongated opening (7) as at the top of the backswing. The counter acting elongated member (4) moved to a more upright position at the top of the backswing but still remains inside the elongated opening (7) and does not make contact with the golfers' back.

It can be noted that the counter acting elongated member (4) is more or less perpendicular to the lower elongated member (1) at the top of the backswing. This position is ideal to counter act any medial rotation of the right arm. During the downswing of the golfer the counter acting elongated member (4) will stay inside the elongated opening (7). This will prevent the right arm from medially rotating (rotating towards the centre of the body). This also prevents the right arm and right shoulder blade from moving horizontally in the downswing and thus preventing the classic "over the top movement" as explained previously.

At some stage during the follow through (after impact with the golf ball) the counter acting elongated member will pull out of the holding device preferably by means of auto retracting to allow the right arm to medially rotate at the very end of the follow through.

I claim:

1. A golf swing teaching device, for preventing medial rotation of a golfers right arm in a backswing and in particular during a downswing of a swing of a golfer's club and consequently assisting in delivering a club head on a path approaching a golf ball in which the path is slightly on the inside (to the left) or square to an intended target line, the golf swing teaching device comprising:

a lower elongated member which, in use, attaches to, and extends along, a lower part of the golfer's right arm below an elbow joint of the right arm;

an upper elongated member which, in use, attaches to, and extends along, an upper part of the right arm above the elbow joint;

an elbow joint which pivotally joins the lower and upper elongated members together, with relative movement of the upper and lower elongated members being restricted to within a single plane;

a rigid counter acting elongated member pivotally attached to and mounted on the lower and upper elongated members and wherein the counter acting elongated member extends from a pivotal attachment on the lower elongated member through a pivotal attachment on the upper elongated member;

a holding device which, in use, attaches to a waist of the golfer which includes an elongated pivoting arm having an elongated opening with rigid walls wherein the elongated opening is located at the end opposite to the pivoting end of the pivoting arm with the elongated pivoting arm attaching to a ratchet device (which allows pivoting in only one direction) by means of a pivoting shaft with the ratchet device attaching to a rounded elongated base section extending in opposite directions, away from the ratchet device and wherein the rounded elongated base section attaches to the waist of the golfer, and whereby the elongated opening allow the counter acting elongated member to slide into, move around and slide out of the elongated opening at certain stages before and during the golf swing with the holding device together with the counter acting elongated member inserted into the elongated opening of the pivoting arm acting as a resistance force during the downswing preventing movement of the end of the counter acting elongated member away from the golfers torso and movement of the counter acting elongated member out of the elongated opening and free of the holding device, thereby to prevent medial rotation of the golfer's right arm during the downswing.

2. The golf swing teaching device as claimed in claim 1, in which, in use, the counter acting elongated member only slide into the elongated opening of the pivoting arm of the holding device at address (when the golfer takes aim and prepare to hit the golf ball) and retract after the club head contacts a golf ball.

3. The golf swing teaching device as claimed in claim 1, in which the lower and upper elongated members are curved and shaped to match the shape of a right hand side of the right arm when it is extended, and thereby ensuring freedom of movement and greater comfort using the golf swing teaching device while restricting only medial rotation of the right arm in the downswing.

4. The golf swing teaching device as claimed in claim 1, in which in use, the lower and upper elongated members are attached to the right arm such that they are on a middle of the right hand side of the right arm, thereby to ensure freedom of movement using the golf swing teaching device while restricting only medial rotation of the right arm in the downswing.

5. The golf swing teaching device as claimed in claim 1, in which, in use, the lower and upper elongated members are attached to the right arm in such a way as to position the elbow joint joining the lower and upper elongated members so that its pivot axis is at right angles to a plane in which the lower part of the right arm moves when it pivots about the right arm's elbow joint, thereby to ensure freedom of movement using the golf swing teaching device while restricting only medial rotation of the right arm in the downswing.

6. The golf swing teaching device as claimed in claim 1, which includes elongated, rounded curved portions which are located astride the lower and upper elongated members, at the ends of the lower and upper elongated members remote from the elbow joint that joins them, for aiding secure attachment of the lower and upper elongated members to the upper and lower parts of the right arm.

7. The golf swing teaching device as claimed in claim 1, in which the counter acting elongated member is mounted on the lower and upper elongated members by means of pivoting attachments to accommodate the hinging of the right elbow during the backswing and downswing and wherein the counter acting elongated member is mounted in a fixed way inside a pivoting attachment mounted on the lower elongated member and wherein the counter acting elongated member extends in a non-fixed manner through a pivoting attachment mounted on the upper elongated member.

8. The golf swing teaching device as claimed in claim 1, in which the counter acting elongated member extends away from the upper elongated member and wherein the counter acting elongated member moves freely into the elongated opening of the pivoting arm and makes no contact with the golfer's back when the club is at the top of the backswing.

9. The golf swing teaching device as claimed in claim 1, in which the counter acting elongated member is of such a length as to allow the counter acting elongated member, in use, to project through and stay inside the elongated opening of the pivoting arm until the club head hits a golf ball.

10. The golf swing teaching device as claimed in claim 1, in which the elongated opening of the pivoting arm of the holding device is of such a size as to allow the counter acting elongated member to move freely inside the elongated opening at address, and during the backswing and the downswing, the only restriction exercised until impact of a golf club with a golf ball being to prevent the counter acting elongated member from moving out of the elongated opening, free of the holding device, and to prevent the end of the counter acting elongated member from moving away from the golfers torso and thus preventing the right arm from medially rotating.

11. The golf swing teaching device as claimed in claim 1 in which the elongated opening of the pivoting arm has rounded edges to assist the counter acting elongated member achieving smooth entry, moving around and sliding out of the elongated opening of the pivoting arm and wherein a vertical face of the elongated opening extends at an angle ensuring that the counter acting elongated member does not move medially during the downswing and wherein the L-shape of the elongated opening ensures smooth exit of the counter acting elongated member from the elongated opening after impact of the club head with a golf ball.

12. The golf swing teaching device as claimed in claim 1 in which the pivoting arm of the holding device is of such a length and height as to allow the counter acting elongated member to comfortably slide into the elongated opening at address, move around during the backswing and exit after impact of the club head with a golf ball.

13. The golf swing teaching device as claimed in claim 1 in which the pivoting arm of the holding device pivots towards the golfers back during the backswing and retains this pivoted position during the downswing by means of a ratchet device attached to the pivoting arm by means of a pivoting shaft and wherein the said ratchet device uses a ratchet pin to engage gears cut into the pivoting shaft thereby allowing only one-directional pivoting of the pivoting arm and ensuring that the counter acting elongated member does not rotate medially in the downswing and exit smoothly after impact of the club head with a golf ball.

14. The golf swing teaching device as claimed in claim 1 in which the pivoting arm has a spiral torsion spring attached to the pivoting shaft allowing the spiral torsion spring to wind up when the pivoting arm is pivoted backward during the backswing or when the golfer slides the pivoting arm backwards for storage purposes and which includes a release mechanism which disengages a ratchet pin from the pivoting shaft's gears to unwind the spiral torsion spring and return the pivoting arm to its' starting position.

* * * * *